US009169775B2

(12) United States Patent
Takagi et al.

(10) Patent No.: US 9,169,775 B2
(45) Date of Patent: Oct. 27, 2015

(54) MULTI-LINK INTERNAL COMBUSTION ENGINE

(71) Applicant: Nissan Motor Co., Ltd., Yokohama-shi, Kanagawa (JP)

(72) Inventors: Yusuke Takagi, Hadano (JP); Yoshiaki Tanaka, Fujisawa (JP); Katsutoshi Nakamura, Atsugi (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 261 days.

(21) Appl. No.: 13/855,848

(22) Filed: Apr. 3, 2013

(65) Prior Publication Data

US 2013/0263816 A1 Oct. 10, 2013

(30) Foreign Application Priority Data

Apr. 4, 2012 (JP) ..... 2012-085107

(51) Int. Cl.

*F02B 75/32* (2006.01)
*F01M 11/00* (2006.01)
*F02B 41/04* (2006.01)

(52) U.S. Cl.

CPC ..... *F02B 75/32* (2013.01); *F01M 11/0004* (2013.01); *F01M 2011/005* (2013.01); *F01M 2011/0033* (2013.01); *F02B 41/04* (2013.01)

(58) Field of Classification Search

CPC ..... F01M 11/0004; F01M 2011/005; F01M 2011/0033
USPC ..... 123/197.1, 195 C, 195 H, 196 R; 184/6, 184/6.5, 106
See application file for complete search history.

(56) References Cited

U.S. PATENT DOCUMENTS

| | | | | |
|---|---|---|---|---|
| 5,038,890 | A * | 8/1991 | Tanaka et al. | 184/6.5 |
| 5,103,782 | A * | 4/1992 | Matsui | 123/195 C |
| 5,960,763 | A * | 10/1999 | Yamamura | F01M 11/0004 123/195 C |
| 6,167,990 | B1 * | 1/2001 | Peng | F01M 11/064 123/196 W |
| 6,340,012 | B1 * | 1/2002 | Yamashita | F01M 11/0004 123/195 C |
| 6,845,743 | B1 * | 1/2005 | Bishop | 123/195 C |
| 7,350,506 | B2 * | 4/2008 | Maezuru et al. | 123/461 |
| 7,802,544 | B2 * | 9/2010 | Kamada | F02B 75/048 123/197.4 |
| 8,196,710 | B2 * | 6/2012 | Hiramatsu | 184/106 |
| 8,261,703 | B2 * | 9/2012 | Yoshikawa et al. | 123/48 B |
| 2006/0180117 | A1 * | 8/2006 | Maezuru | F01M 9/06 123/196 R |
| 2010/0050992 | A1 * | 3/2010 | Nakanishi | F02D 15/02 123/48 B |
| 2012/0285412 | A1 * | 11/2012 | Brendel | F02B 75/048 123/192.2 |

FOREIGN PATENT DOCUMENTS

JP 3-43513 U 4/1991

* cited by examiner

*Primary Examiner* — John Kwon
*Assistant Examiner* — James Kim
(74) *Attorney, Agent, or Firm* — Young Basile

(57) ABSTRACT

A multi-link internal combustion engine generally includes a cylinder block, an oil pan mounted to the undersurface of the cylinder block to define a crank chamber, the oil pan being formed with a shallow bottom portion and a deep bottom portion for storing oil. The multi-link internal combustion engine further includes a multi-link, piston-crank mechanism disposed in the crank chamber, a pivotal link member of the piston-crank mechanism pivotal about a pivotal fulcrum located on the side of oil pan; and an oil guide wall provided on the shallow bottom portion in the crank chamber for guiding the oil displaced due to the movement of the pivotal link member to the side of deep bottom portion.

10 Claims, 9 Drawing Sheets

MULTI-LINK INTERNAL COMBUSTION ENGINE

CROSS-REFERENCE TO RELATED APPLICATIONS

This application claims priority under 35 U.S.C. §119 to Japanese Patent Application No. 2012-085107. The entire disclosure of Japanese Patent Application No. 2012-085107 is hereby incorporated herein by reference.

TECHNICAL FIELD

The present disclosure generally relates to an internal combustion engine with a multiple-link, piston-crank mechanism. More specifically, the present disclosure relates to a lower structure of a crank chamber formed by a cylinder block and an oil pan.

BACKGROUND

Japanese Utility Model Publication No. 3-43,513 describes, in an oil pan structure including a deep bottom portion for storing oil to be sucked up by an oil pump and a shallow bottom portion shallower than the deep bottom portion close to the rotational components, an inclined surface formed in the shallow bottom portion lowering toward the deep bottom portion and lowering along the direction of rotation of the crank shaft so that the oil in the shallow bottom portion easily flows into the deep bottom portion.

BRIEF SUMMARY

Because the conventional technique described above assumes a configuration in which the shallow bottom portion of oil pan is disposed close to the crank shaft, in a multi-link combustion engine system constituted by a plurality of link members for the piston-crank mechanism where a close placement to crank shaft would be unavailable due to the presence of the link members on the side of or closer to the oil pan than the crankshaft, it is therefore difficult to return oil efficiently in the shallow bottom portion of the oil pan to the deep bottom portion.

According to the present disclosure, in a multi-link, internal combustion engine having a swing or pivotal link member pivotal about a swing or pivotal fulcrum located on the side of oil pan rather than the crank shaft, an oil guide wall portion is provided to direct oil displaced by movement of the pivotal link member toward the deep bottom portion.

According to the present invention, since the oil displaced by the pivotal movement or oscillation of the pivotal link member is directed to the side of deep bottom portion by the oil guide wall. Therefore, even if oil flows into the shallow bottom portion during turning of the vehicle and the like, oil may be returned efficiently to the deep bottom portion of the oil pan so that an oil strainer disposed in the deep bottom portion is kept in a stable state and prevented from being exposed above the oil level.

BRIEF DESCRIPTION OF THE DRAWINGS

Referring now to the attached drawings which form a part of this original disclosure.

DETAILED DESCRIPTION OF SELECTED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
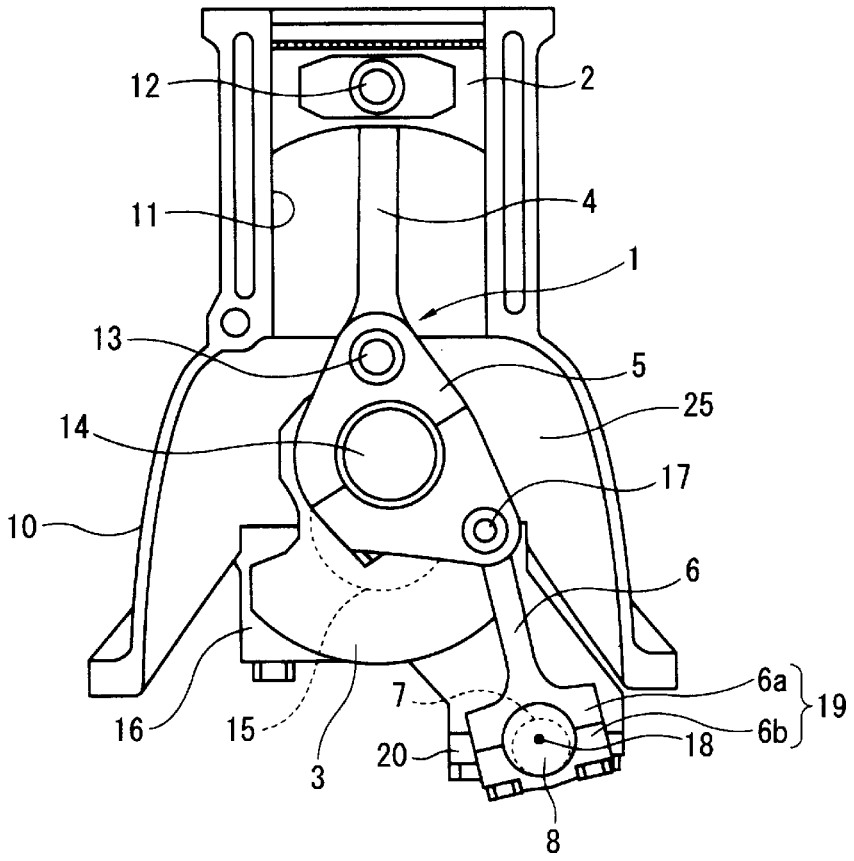
FIG. 1 is an explanatory diagram showing a schematic configuration of a multi-link, internal combustion engine to which the teachings herein are applied.
Figure 2:
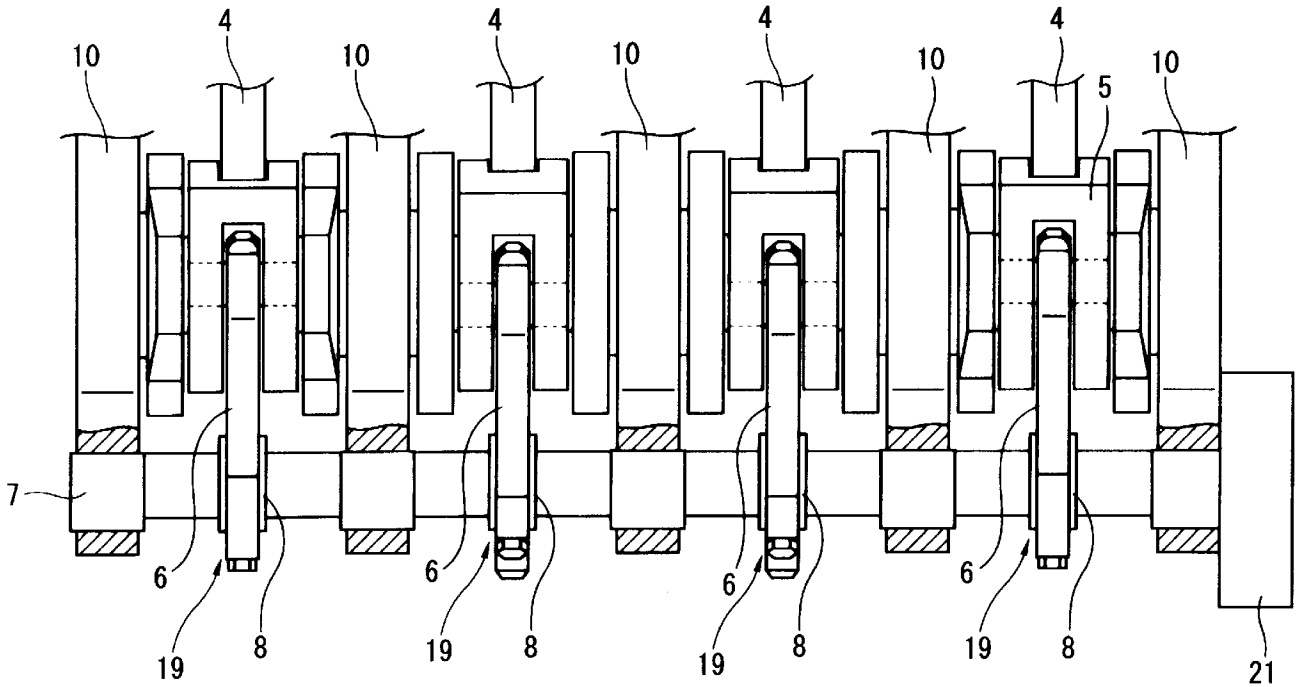
FIG. 2 is a side view showing the structure near a control shaft.

FIGS. 1 and 2 show an example of the base structure of the internal combustion engine with a multi-link, piston-crank mechanism 1 to which the present invention is applicable. FIG. 1 shows a schematic structure of an inline four-cylinder whereas FIG. 2 shows a side view of the multi-link, piston-crank mechanism 1.

The piston-crank mechanism 1 generally includes an upper link 4 and a lower link 5 for connecting a piston 2 and a crank shaft 3, a control link 6 configured as a swing or pivotal link member to restrict movements of upper link 4 and lower link 5, and a control shaft 7 having an eccentric shaft portion 8 to which an end of control link 6 is pivotally connected.

The piston 2 is slidably disposed in a cylinder 11 formed in the cylinder block 10 and rotatably connected via a piston pin 12 to one end of the upper link 4 (the upper end in FIG. 1). The other end of the upper link 4 (the lower end in FIG. 1) is rotatably connected to one end of the lower link 5 via a first connecting pin 13. The lower link 5 is rotatably attached at the center thereof to a crank pin 14 of the crank shaft 3.

The crank shaft 3 is provided with a plurality of journal portions 15 and crank pins 14, and each journal portion 15 is rotatably supported between a crank shaft bearing bracket 16 and the cylinder block 10. The crank pin 14 is spaced from the journal portion 15 by a preset distance, to which the lower link 5 is rotatably connected.

The control link 6 for restricting the movement of lower link 5 is connected at one end (the upper end in FIG. 1) thereof to the other end of the lower link rotatably via a second connecting pin 17 while it is pivotally supported at the other end (the lower end in FIG. 1) in the cylinder block 10 forming a part of the body of internal combustion engine. In other words, the control link 6 is positioned relatively closer to an oil pan 26 described below than to the crank shaft 3. Further, the control link 6 has the other end thereof positioned on the side of oil pan 26, rather than the crank shaft 3, and is pivotal about the pivotal fulcrum 18 at the other end. Moreover, the end of the control link 6 is displaceable in its pivotal fulcrum 18 with respect the body of the internal combustion engine so change a compression ratio of the internal combustion engine. More specifically, an eccentric shaft portion 8 eccentrically provided with respect to the control shaft 7 extending substantially parallel to the crank shaft is rotatably connected to the other end of the control link 6.

Further, the other end of the control link 6 has a large end portion 19 of split structure with a body portion 6*a* and a cap portion 6*b* sandwiching eccentric shaft portion 7 and is shaped with broader width with respect to the rod of the control link 6.

The control shaft 7 is rotatably supported between the crank bearing bracket 15 and control shaft bearing bracket 20.

In the present embodiment, the control shaft 7 is formed with eccentric shaft portions 8 at four locations thereof, and each of these eccentric shaft portions 8 is connected to the associated control link 6 of the four cylinders.

Further, at one end of the control shaft 7 is attached an actuator 21 such as an electric motor. When the control shaft 7 is rotatably driven by the actuator 21, the center position of the eccentric shaft portion 8 forming a pivotal fulcrum 18 of control link 6 is displaced with respect to the engine body. Thus, the restriction or constraint condition on the movement of the lower link by way of the control link 6 is changed along with the change in the stroke position of the piston 2 to the crank angle so that the compression ratio will be changed.

Figure 3:
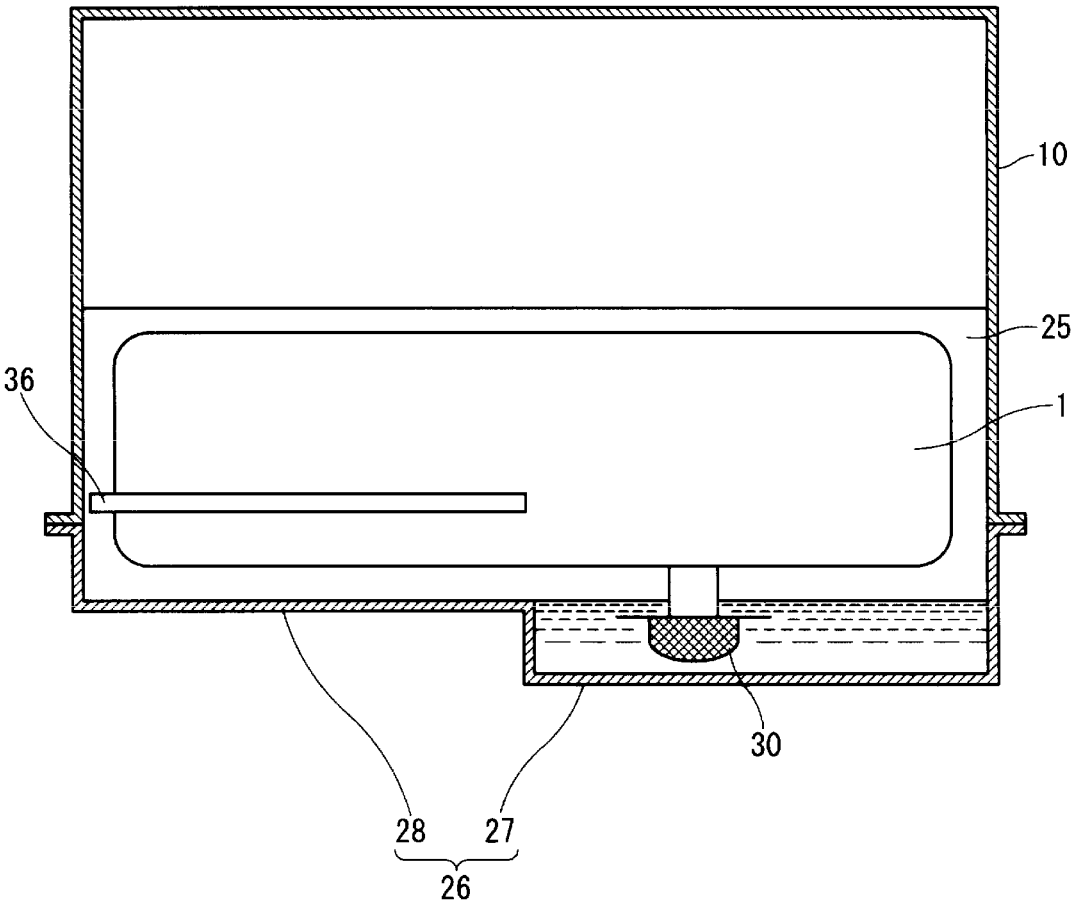
FIG. 3 is an explanatory diagram schematically showing the arrangement state of a plate member in a crank chamber in a first embodiment according to the present invention.

Such a piston-crank mechanism 1 is disposed within the crank chamber 25, as shown in FIG. 3. The crank chamber 25 is a space that is defined by the cylinder block 10 and the oil pan 26 attached to the undersurface of the cylinder block 10.

In the present embodiment, the oil pan 26 is shaped in an elongate rectangular plate along the cylinder row direction (in the left to right direction in FIG. 3), and is formed with a deep bottom portion 27 for storing oil (lubricating oil) at the side of one end of this cylinder row whereas, and at the side of the other end of the cylinder row, with a shallow bottom portion 28 shallower than the deep bottom portion 27.

In the present embodiment, the internal combustion engine is structured in an inline four-cylinder, and when referring to first cylinder, second cylinder, third cylinder, and fourth cylinder in order from one end of the cylinder row direction, the deep bottom portion 27 is positioned below the first and second cylinders while the shallow bottom portion is positioned below the third and fourth cylinders. The oil (lubricating oil) stored in the deep bottom portion 27 is sucked into the oil pump (not shown) through an oil strainer 30 disposed in the deep bottom portion 27.

Moreover, a plate-shaped plate member 36 with the oil guide wall 35 to be described later is disposed in the position on the side of shallow bottom portion 28 of oil pan 26 in the crank chamber 25, This plate member 36 is disposed generally perpendicular to both the vertical direction of engine and the direction of cylinder row, and, as shown in FIG. 3, is placed horizontally in the crank chamber 25. Here, the vertical direction denotes the direction along the axis of cylinder 11 in the case of in-line internal combustion engine. In the case of a V-type internal combustion engine, the vertical direction of engine is defined by a direction along a bank center line dividing equally a bank angle of the V-engine.

Figure 4:
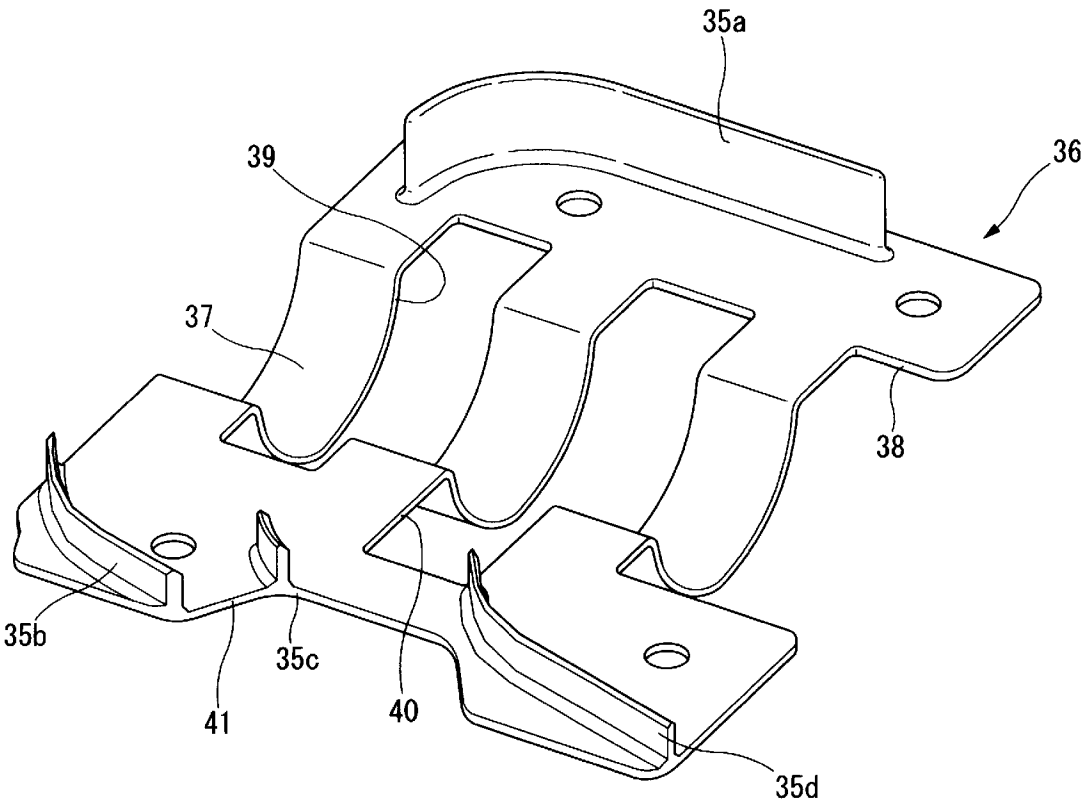
FIG. 4 is a perspective view of the plate member.
Figure 5:
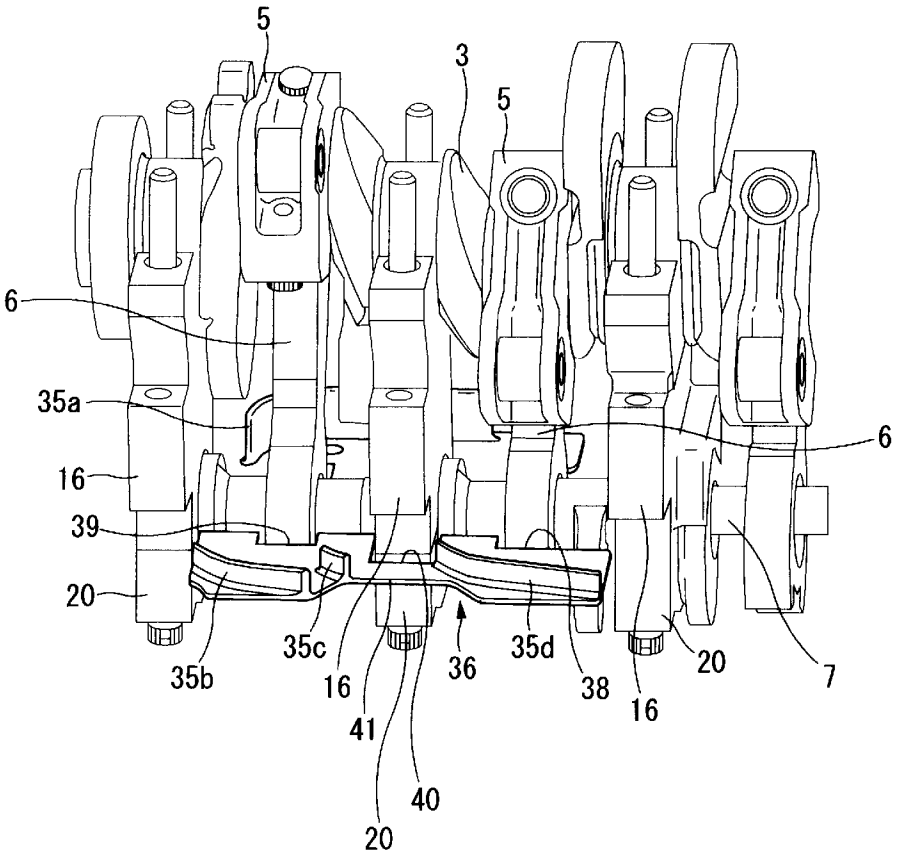
FIG. 5 is an explanatory diagram schematically showing the inside of the crank chamber of the internal combustion engine.
Figure 6:
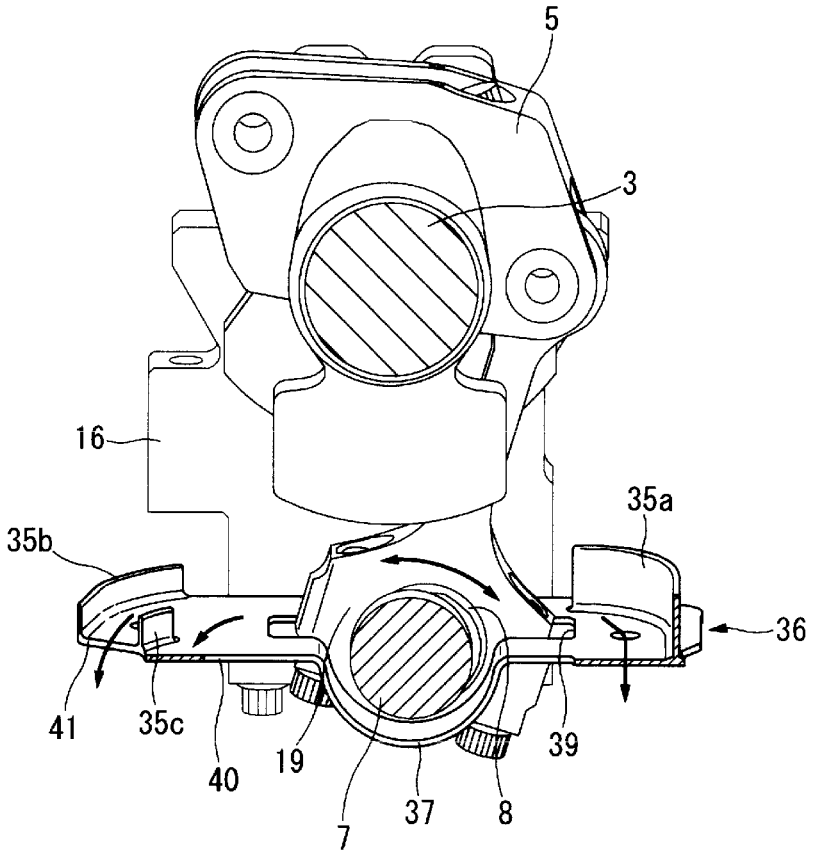
FIG. 6 is a perspective view of the crank shaft and plate member.

Now, the plate member 36 and the oil guide wall 35 will be described in detail with reference to FIGS. 4 to 6. Note that, in the piston-crank mechanism 1 in FIGS. 4 to 6, the control shaft 7 is located beneath the crank shaft 3, i.e., directly below the crank shaft along the axis line of cylinder 11. Further, in FIG. 6, the crank shaft 3 is assumed to rotate clockwise.

The plate member 36 has an arc-shaped curved portion 37 in the central portion thereof, and disposed in the crank chamber 25 with this curved portion 37 protruding toward the side of oil pan 26 and fixed to the cylinder block 10 or oil pan 26. This curved portion 37 is configured not to interfere with the control shaft 7, and formed over the entire length of the plate member 36 along the direction of cylinder row.

Further, the plate member 36 includes a rectangular notch or cut-out portion 38 formed on the central portion at one side (right side in FIGS. 4 and 5) as well as two rectangular slits 39 formed through across the curved portion 37.

The notch portion 38 is formed in an elongate notch extending along the pivotal direction of the large end 19 of the control link 6, and is configured not to interfere with the large end 19 of the control like associated with the third cylinder.

The first slit 39 is an elongate through hole extending along the pivotal direction of large end 19 of the control link 6 corresponding to the fourth cylinder, and is configured not to conflict with the large end 19 of control link 6 corresponding to the fourth cylinder.

The second slip 40 is formed in such a way that the crank bearing bracket 15 and control bearing bracket 20 rotatably supporting the control shaft 7 between the third and fourth cylinder in the direction of the cylinder row may pass through.

Stated another way, the plate member 36 is configured to be positioned as a whole between the piston-crank mechanism 1 and oil pan 26 with positioning the control shaft 7 inside of the curved portion 37. In addition, the plate member 36 is configured to be located on the side of the crank shaft 3 than such a position that is closest to the crank shaft 3 among the motion trajectories of the large portion 19 of the control link 6. The plate member 36 is further configured to be located even closer to the oil pan 26 than such a position closest to the oil pan 26 among motion trajectories expressed by both the crank shaft 3 and the link member of the piston-crank mechanism 1 excluding the control link 6.

In other words, the plate member 36 is located on the side of crank shaft, i.e. above the lowest position, in the vertical direction of engine, the motion trajectory of large end 19 of control link 6 can take, on the one hand, and further located on the side of oil pan 26. i.e. even lower than the position closes to the oil pan 26 the motion trajectories of crank shaft 3 and the link members of piston-crank mechanism 1 excluding control link 6 can take.

In addition, in the present embodiment, an oil guide wall 35 is formed on the surface of the plate member 36 facing the crank shaft 3.

This oil guide wall 36 is intended to guide oil displaced due to the pivotal movement of the control link 6 from the shallow bottom portion 28 of oil pan 26 toward the deep bottom portion 27. Oil guide wall is provided on both sides of the curved portion 37.

More specifically, the oil guide wall 35 is structured to extend along the crank shaft axis and to form a vertical wall substantially perpendicular to the plate member 36. In other words, the oil guide wall 35 forms an angle with the bottom wall of the shallow portion 28 to extend along the axis of crank shaft. Moreover, as shown in FIGS. 4-6, this oil guide wall 35 is configured to be located closer to the center side of the oil pan 26 at the other end of the shallow bottom portion than at the one end of the deep bottom portion 27 as viewed in the axial direction of crank shaft. In other words, the oil guide wall 35 is located above the lowest position, in the vertical direction of engine, the motion trajectory of large end 19 of control link 6 can take, on the one hand, and further located even lower than the lowest position the motion trajectories of crank shaft 3 and the link members of piston-crank mechanism 1 excluding control link 6 can take.

Further, in the present embodiment, the plate member 36 is formed with four oil guide walls 35. More specifically, an oil guide wall 35*a* is formed on one side of the curved portion 37 while, on the other side of the curved portion 37, three oil guide walls 35*b*, 35*c*, and 35*d* are formed.

The oil guide wall 35*a* is formed continuously along the direction of cylinder row in order to cover the outside of the large end portion 19 of control link 6 corresponding to the fourth cylinder, the crank bearing bracket 15 and control shaft bearing bracket 20 positioned between the third and fourth cylinders to rotatably support the control shaft 7. This oil guide wall 35*a* caused, as shown by arrow in FIG. 6, the oil displaced to the other side of the plate member 36 (left side in FIG. 6) due to pivotal movement of the control link corresponding to the fourth cylinder to be induced to oil drop cutout portion 41.

Since this oil drop cutout portion 41 is positioned on the one side in the direction of cylinder row than the control link 6 corresponding to the fourth cylinder, the oil displaced to the other side of the plate member 36 due to oscillation of the control link 6 associated with the fourth cylinder will be guided and induced to the side of deep bottom portion 27 by the oil guide walls 35*b*, 35*c*.

The oil guide wall 35*d* is formed outside of the large end 19 of the control link 6 corresponding to the third cylinder. This oil guide wall 35*d* induces the oil displaced to the plate member 36 on the other side due to oscillation of control link 6 corresponding to the third cylinder to the side of the deep bottom portion.

Therefore, on the side of the shallow bottom portion 28 of the oil pan 26 defining the crank chamber 25, since the oil displaced by the swing or pivotal movement or oscillation of the control link 6 in the oscillating direction of control link 6 is directed or guided to the side of deep bottom portion 27 by the oil guide wall 35. Therefore, even if oil in the oil pan 26 flows toward the shallow bottom portion 28 during turning of the vehicle and the like, oil may be returned efficiently to the deep bottom portion 27 of the oil pan 26 so that an oil strainer 30 disposed in the deep bottom portion 27 is kept in a stable state and prevented from being exposed above the oil level.

In other words, even in a multi-link, piston-crank mechanism 1 with a link member pivotal about pivotal fulcrum on the side of the oil pan, by providing an oil guide wall 35, without placing the shallow bottom portion 25 of the oil pan 26 close to the crank shaft 3, oil may be returned efficiently from the side of shallow bottom portion 28 toward the deep bottom portion 28.

Further, by providing an oil guide wall 35, the situation may be securely maintained in which the oil strainer 30 would be prevented from being exposed out of oil level without configuring the depth of the deep bottom portion 27 large and placing the oil strainer 27 down immediately to the bottom wall side of the deep bottom portion 27. Therefore, overall internal combustion engine can be made relatively light and the total height of the internal combustion engine may be kept relatively small so that the object vehicles the engine thus structured may be installed in can be increased.

Moreover, in order to prevent contamination of air from the oil strainer 30, it is not necessary to increase the amount of oil in the oil. Thus, it is possible to suppress an increase in friction caused by the piston-crank mechanism hitting on the oil surface, and to improve the output of the internal combustion engine as well as fuel efficiency.

Moreover, in order to prevent contamination of air from the oil strainer 30, it is not necessary to increase the amount of oil in the oil. Thus, it is possible to suppress an increase in friction caused by the piston-crank mechanism hitting on the oil surface, and to improve the output of the internal combustion engine as well as fuel efficiency.

In addition, if the oil guide wall 35 is configured in such a way that its tip end portion is located on the side of crank shaft 3 of the large end 19 of the control link 6, oil displaced due to oscillation of control link 6 may be even effectively guided to the side of deep bottom portion 27 of oil pan. In the present embodiment, among the oil guide walls 35 provided on the both sides of curved portion 37, the one (right side in FIG. 6) oil guide wall 35*a* is structured such that its tip is located on the crank shaft 3 side of the large portion 19 of the control link 6.

Further, in the embodiment described above, oil guide wall 35 is provided on the both sides of control link 6 as viewed along the axis of crank shaft, the oil guide wall 35 may be provided only on one side of the control link 6. Even in this case, by making use of oscillation or pivotal movement, oil may be returned to the deep bottom portion 27 of oil pan 26 to some extent.

Still further, in the embodiment described above, the plate member 36 is formed integrally with the oil guide wall 45. However, there is no need of the integrity, Rather, the oil guide wall 35 and plate member 36 may be separately structured, Also, the plate member 36 may be omitted, and instead, the oil guide wall 35 may protrude from the bottom wall of the shallow bottom portion 28.

Moreover, in the present embodiment, one plate member 36 is configured to be disposed in the shallow bottom portion 28 of the oil pan 26 within the crank chamber 25. However, it is not necessary to form the plate member 36 in one piece. For example, the plate member 36 may be divided so that a plurality of member plates is configured to be disposed in the shallow bottom portion 28 of the oil pan 26 within the crank chamber 25.

Figure 7:
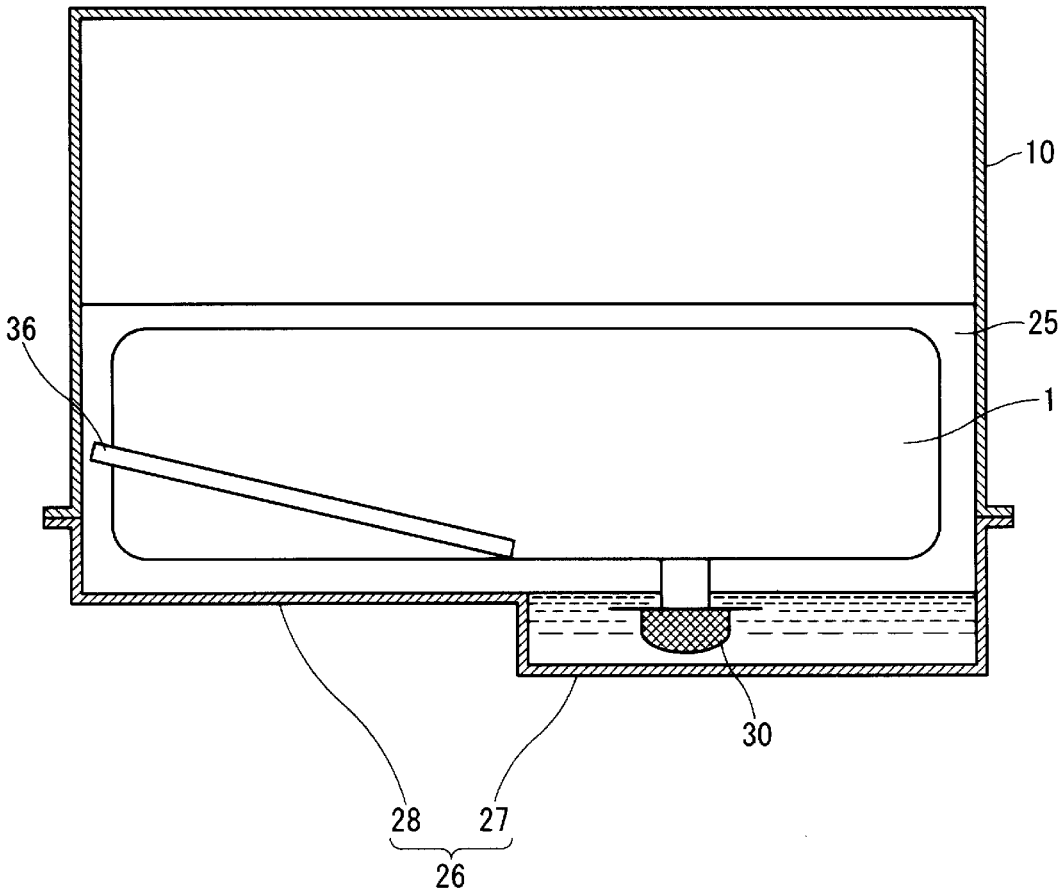
FIG. 7 is a second embodiment in which a plate member is disposed in a state inclined in the vertical direction of engine as disclosed herein.
Figure 8:
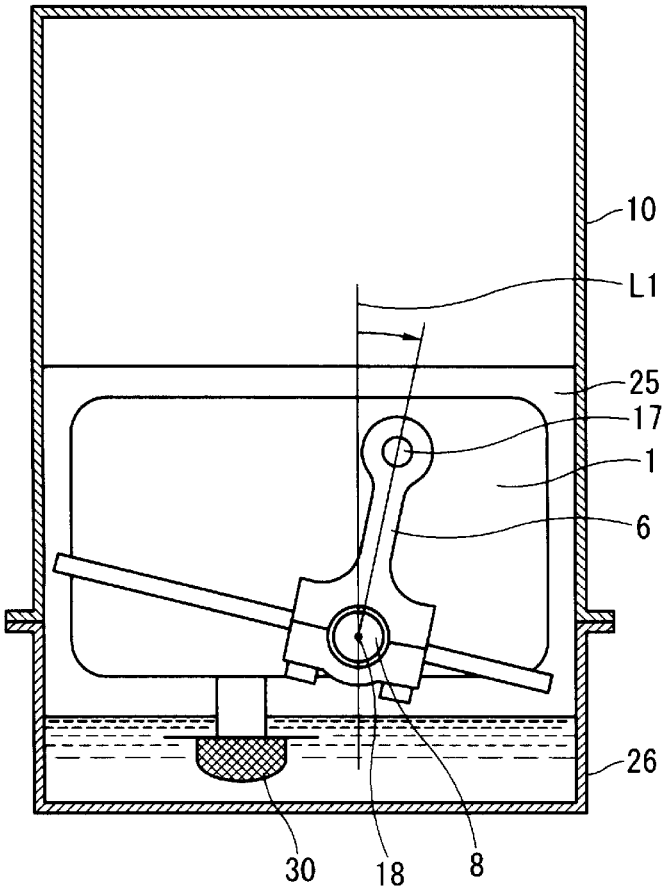
FIG. 8 is a third embodiment viewed in the axial direction of the crank shaft as disclosed herein.
Figure 9:
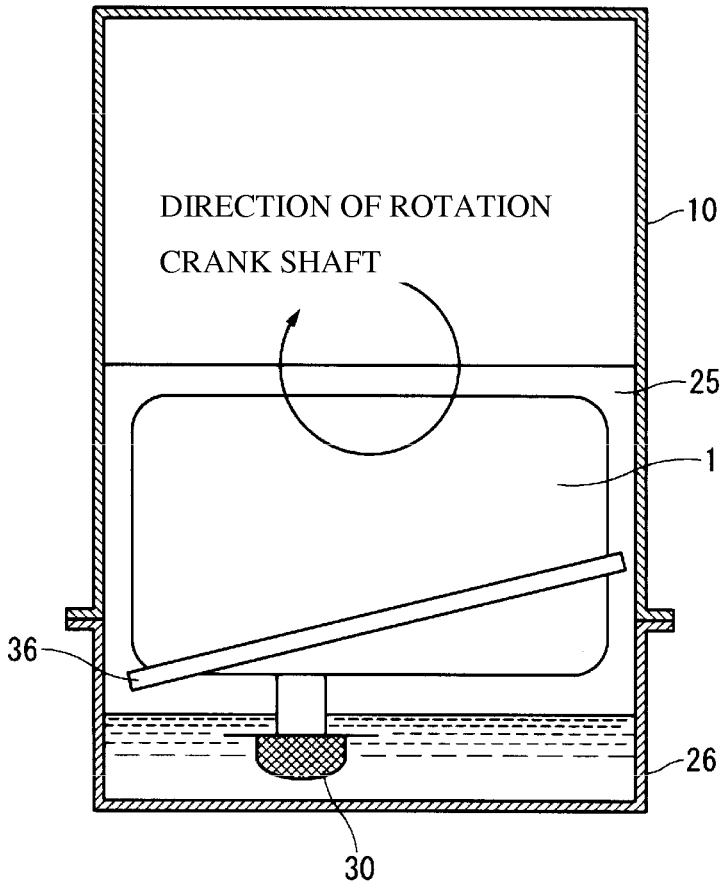
FIG. 9 is a fourth embodiment viewed in the axial direction of the crank shaft as disclosed herein.

Also, it is possible that the plate member 36 is disposed in a state inclined in the crank chamber 25, as shown in FIGS. 7 to 9.

FIG. 7 shows a second embodiment in which the plate member 36 is disposed in a state inclined in the vertical direction of engine toward the oil pan 26 in the crank chamber 25 so that the one side (right side in FIG. 7) of the plate member 36 is disposed closer to the bottom wall of the shallow bottom portion 28 of the oil pan 26. Specifically, in the second embodiment, the plate member 36 is inclined toward to the deep bottom portion 27 of the oil pan 27 with the portion located in the deep bottom portion 27 positioned closer. In this second embodiment, due to inclined plate member 36, oil on the plate member 36 may be returned efficiently to the deep bottom portion 27 of the oil pan 26.

FIG. 8 shows a third embodiment viewed in the axial direction of the crank shaft in which the plate member 36 is disposed in a state inclined in the vertical direction of engine toward the oil pan 26 in the crank chamber 25 so that the plate member 36 is inclined to be closer to the bottom wall of the shallow bottom portion 28 of the oil pan 26 at a position on the side of the center of the one end (second connecting pin 17) of the control link 6 with respect to a straight line L1 that extends along the vertical direction of the engine passes through the center of the other end (pivotal fulcrum 18) of control link 6 when the control link 6 is positioned in the center of pivotal.

Further, the plate member 36 may be inclined in the vertical direction of engine to be closer to the bottom wall of the shallow bottom portion 28 of the oil pan 26 as the position advances leftwards when the crank shaft rotates clockwise as viewed in the axial direction of the crank shaft, or as the position advances rightwards when the crank shaft rotates counter-clockwise.

FIG. 9 shows a fourth embodiment viewed in the axial direction of the crank shaft in which the plate member 36 is disposed in a state inclined in the vertical direction of engine toward the oil pan 26 in the crank chamber 25 so that the plate member 36 is inclined to be closer to the bottom wall of the shallow bottom portion 28 of the oil pan 26 when the position advances leftwards (left side in FIG. 9) of crank chamber 25 at the rotation of crank shaft 3 clockwise. In this fourth embodiment, by using the gas flow in the crank chamber 25 caused by rotation of the crank shaft 3, oil can be easily collected to the side of inclination of the plate member 36 (left side in FIG. 9). Therefore, it is possible to cause oil on the plate member 36 to return more efficiently to the side of deep bottom portion 27 of the oil pan 26.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A multi-link internal combustion engine comprising:

a cylinder block; an oil pan mounted to an undersurface of the cylinder block to define a crank chamber, the oil pan being formed with a shallow bottom portion and a deep bottom portion for storing oil;

a plate member disposed above the oil pan in the crank chamber, the plate member including a slit;

a multi-link, piston-crank mechanism disposed in the crank chamber and overlying the deep bottom portion and the shallow bottom portion;

a pivotal link member of the piston-crank mechanism overlying the shallow bottom portion and pivotal about a pivotal fulcrum located closer to the oil pan than a crank shaft, the pivotal link member extending though the slit of the plate member; and an oil guide wall formed on the plate member and extending away from the oil and located about the pivotal link member for guiding the oil displaced by movement of the pivotal link member toward the deep bottom portion.

2. The multi-link internal combustion engine claimed in claim 1, wherein the oil guide wall is a vertical wall extending along an axial direction of the crank shaft outboard of a longitudinal center of the oil pan when viewed in the axial direction of the crank shaft.

3. The multi-link internal combustion engine claimed in claim 1, wherein the piston-crank mechanism includes:

an upper link connected with one end thereof to a piston;

a lower link connected to the upper link and rotatably connected to the crank shaft; and a control link representing the pivotal link member connected with one end thereof to the lower link and with the other end to an eccentric cam portion of a control shaft defining the pivotal fulcrum, wherein a compression ratio of the internal combustion engine is subject to change in accordance with a rotational position of the control shaft.

4. The multi-link internal combustion engine claimed in claim 1, wherein:

the plate member is overlying the shallow bottom portion, wherein the oil guide wall is formed on a surface of the plate member on a side of the crank shaft.

5. The multi-link internal combustion engine claimed in claim 4, wherein the plate member is inclined toward the oil pan as a position thereof advances towards the deep bottom portion.

6. The multi-link internal combustion engine claimed in claim 4, wherein, as viewed in an axial direction of the crank shaft, a straight line passes through the pivotal fulcrum and extends in a vertical direction, the pivotal link member extends to one side of the straight line, and the plate member is inclined further toward the oil pan on the one side of the straight line than on the other side of the straight line.

7. The multi-link internal combustion engine claimed in claim 4, wherein, as viewed in an axial direction of the crank shaft, the crank shaft rotates clockwise, the plate member has a right-hand side and a left-hand side, and the plate member is inclined in a vertical direction of the engine such that the left-hand side of the plate member is closer to the oil pan than the right-hand side.

8. The multi-link internal combustion engine claimed in claim 3, wherein:

a large end portion of the control link is rotatably mounted to the pivotal fulcrum, the upper link, the lower link and the control link are each subject to movement defining respective motion trajectories, and the oil guide wall is located, in a vertical direction of the engine, about the motion trajectory of the large end of the control link, and closer to the oil pan than the crank shaft and the motion trajectories of the upper link and the lower link.

9. The multi-link internal combustion engine claimed in claim 1, wherein a large end portion of the pivotal link member is rotatably mounted to the pivotal fulcrum, and the oil guide wall is located about the large end portion of the pivotal link member with a distal tip of the oil guide wall extending beyond the large end portion of the pivotal link member.

10. The multi-link internal combustion engine claimed in claim 1, wherein, as viewed in an axial direction of the crank shaft, the crank shaft rotates counter-clockwise, the plate member has a right-hand side and a left-hand side, and the plate member is inclined in a vertical direction of the engine such that the right-hand side of the plate member is closer to the oil pan than the left-hand side.

* * * * *